US011288995B2

(12) United States Patent
Hou et al.

(10) Patent No.: US 11,288,995 B2
(45) Date of Patent: Mar. 29, 2022

(54) PIXEL DATA OPTIMIZATION METHOD, PIXEL MATRIX DRIVING DEVICE AND DISPLAY APPARATUS

(71) Applicant: Xianyang Caihong Optoelectronics Technology Co.,Ltd, Xianyang (CN)

(72) Inventors: Yu Hou, Xianyang (CN); Xiaohua Huang, Xianyang (CN); Yuyeh Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 17/196,300

(22) Filed: Mar. 9, 2021

(65) Prior Publication Data

US 2021/0295756 A1 Sep. 23, 2021

(30) Foreign Application Priority Data

Mar. 19, 2020 (CN) ..... 202010196607.7

(51) Int. Cl.
*G09G 3/20* (2006.01)

(52) U.S. Cl.
CPC ..... *G09G 3/20* (2013.01); *G09G 2310/027* (2013.01); *G09G 2310/08* (2013.01)

(58) Field of Classification Search
CPC . G09G 3/20; G09G 2310/08; G09G 2310/027
See application file for complete search history.

(56) References Cited

U.S. PATENT DOCUMENTS

| | | | | |
|---|---|---|---|---|
| 7,046,256 | B2 * | 5/2006 | Credelle | G09G 3/2003 345/204 |
| 7,184,066 | B2 * | 2/2007 | Elliot | G09G 3/20 345/694 |
| 7,221,381 | B2 * | 5/2007 | Brown Elliott | G09G 3/2003 345/690 |
| 7,283,142 | B2 * | 10/2007 | Credelle | G09G 3/20 345/589 |
| 9,886,882 | B2 * | 2/2018 | He | G09G 3/2051 |
| 10,283,031 | B2 * | 5/2019 | Herranz | G09G 3/2092 |
| 10,706,771 | B2 * | 7/2020 | Hwang | G09G 3/3266 |
| 2009/0219306 | A1 * | 9/2009 | Oh | G09G 3/3225 345/690 |

(Continued)

*Primary Examiner* — Grant Sitta
(74) *Attorney, Agent, or Firm* — WPAT, PC

(57) ABSTRACT

A pixel data optimization method, a pixel matrix driving device and a display apparatus are provided. The method includes: obtaining a first pixel data set; obtaining a second pixel data set according to the first pixel data set; obtaining an initial amplitude difference according to pixel data of each two adjacent rows of pixels in the second pixel data set; and obtaining pixel output data of n rows*M columns of pixels according to the initial amplitude difference and a preset threshold. By comparing the initial amplitude difference obtained from the pixel data of each two adjacent rows of pixels with the preset threshold, a pixel grayscale value to be final displayed of each pixel can be adjusted according to a comparison result, so that an energy consumption and an overheating phenomenon of the pixel matrix driving device can be improved, and a visual effect can be improved.

7 Claims, 2 Drawing Sheets

(56) References Cited

U.S. PATENT DOCUMENTS

| | | | | |
|---|---|---|---|---|
| 2009/0225105 | A1* | 9/2009 | Park | G09G 3/3688 345/690 |
| 2011/0254759 | A1* | 10/2011 | Mori | G09G 3/3607 345/88 |
| 2012/0044275 | A1* | 2/2012 | Kobayashi | G09G 3/20 345/690 |
| 2012/0086743 | A1* | 4/2012 | Shiomi | G09G 3/3659 345/694 |
| 2015/0049123 | A1* | 2/2015 | Choi | G09G 3/2003 345/690 |
| 2015/0255025 | A1* | 9/2015 | Chen | G09G 3/3607 345/589 |
| 2017/0069250 | A1* | 3/2017 | Wang | G09G 3/2074 |
| 2018/0137830 | A1* | 5/2018 | Lee | G09G 3/3607 |
| 2018/0277049 | A1* | 9/2018 | Pan | G09G 3/2074 |
| 2019/0385548 | A1* | 12/2019 | Chen | G09G 3/3688 |

* cited by examiner

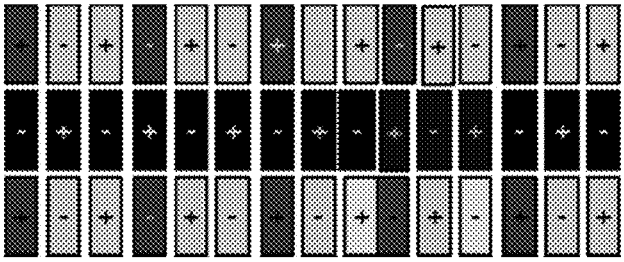

FIG. 1 obtaining a first pixel data set, wherein the first pixel data set comprises pixel data of N rows and M columns of pixels, the pixel data of each of the N rows and M columns of pixels comprises pixel data of three sub-pixels obtaining a second pixel data set according to the first pixel data set, wherein the second pixel data set comprises the pixel data of n rows and M columns of pixels in the N rows and M columns of pixels, $1<n\leqslant N$, and n is a positive integer obtaining an initial amplitude difference according to the pixel data of each two adjacent rows of pixels of the n rows and M columns of pixels in the second pixel data set obtaining pixel output data of the n rows and M columns of pixels according to the initial amplitude difference and a preset threshold

FIG. 2

| | 1 | 2 | 3 | 4 | 5 | 6 | 7 | 8 | 9 | 10 | 11 | 12 | |
|---|---|---|---|---|---|---|---|---|---|---|---|---|---|
| n+1 | R1p1 | G1p1 | B1p1 | R2p1 | G2p1 | B2p1 | R3p1 | G3p1 | B3p1 | R4p1 | G4p1 | B4p1 | ... |
| n+2 | R1c2 | G1c2 | B1c2 | R2c2 | G2c2 | B2c2 | R3c2 | G3c2 | B3c2 | R4c2 | G4c2 | B4c2 | ... |
| n+3 | R1p3 | G1p3 | B1p3 | R2p3 | G2p3 | B2p3 | R3p3 | G3p3 | B3p3 | R4p3 | G4p3 | B4p3 | ... |
| n+4 | R1c4 | G1c4 | B1c4 | R2c4 | G2c4 | B2c4 | R3c4 | G3c4 | B3c4 | R4c4 | G4c4 | B4c4 | ... |

FIG. 3

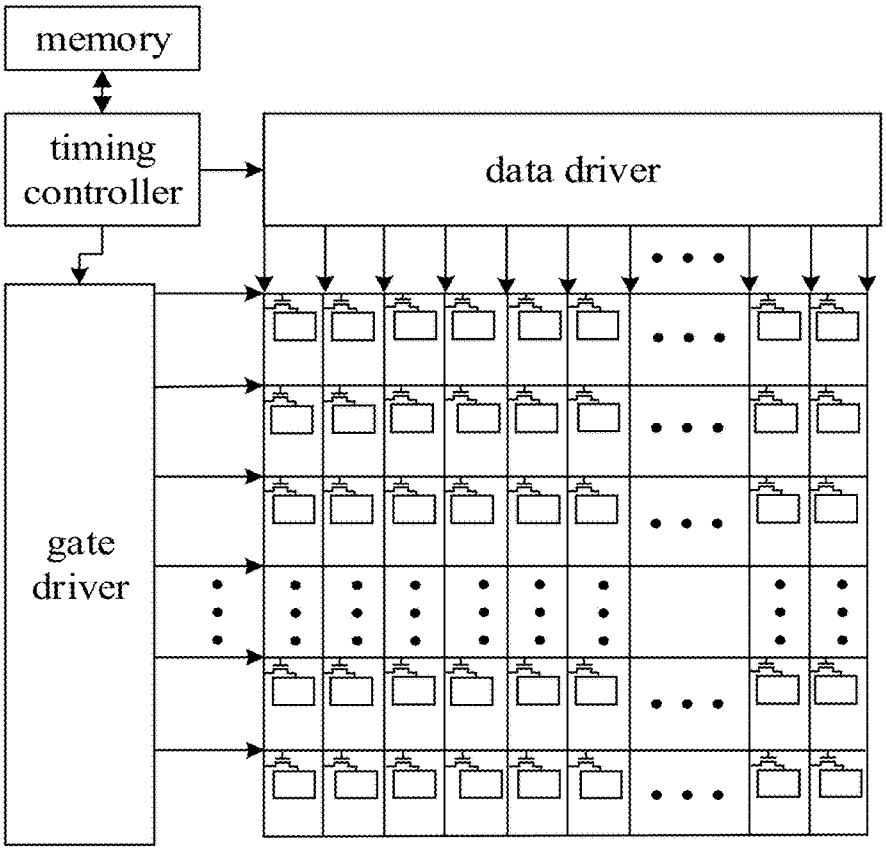
FIG. 4
| | pixel arrangement | Degree of improvement | | Actual measured temperature/°C | | | | | |
|---|---|---|---|---|---|---|---|---|---|
| | | reduce amplitude | reduce frequency | AVE | COF1 | COF2 | COF3 | COF4 | COF5 |
| H-stripe /°C | 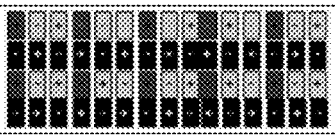 | | | 105 | 105.2 | 100 | 106 | 108 | 107 |
| reduce amplitude /°C | 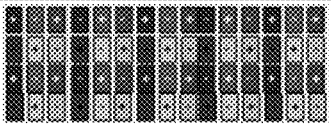 | 50% | | 63.7 | 63.6 | 62.5 | 62.4 | 65.2 | 64.8 |
| | | 66.70% | | 59.3 | 59.3 | 57.5 | 62.5 | 56.2 | 60.9 |
| reduce frequency /°C | 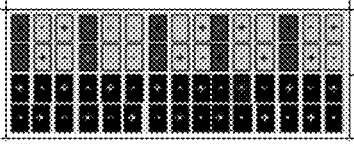 | | 50% | 76.8 | 75.6 | 76.3 | 78.4 | 76.5 | 77.4 |
| | | | 66.70% | 71.1 | 72.1 | 70.8 | 72.1 | 70.5 | 70.2 |
FIG. 5

PIXEL DATA OPTIMIZATION METHOD, PIXEL MATRIX DRIVING DEVICE AND DISPLAY APPARATUS

CROSS REFERENCE TO RELATED APPLICATION

The disclosure claims the priority of the Chinese Patent Application No. 202010196607.7, entitled "Pixel Data Optimization Method, Pixel Matrix Driving Device and Display Apparatus", filed on Mar. 19, 2020, and the content of which is incorporated herein by reference in its entirety.

FIELD OF THE DISCLOSURE

The disclosure relates to the field of image display technology, and more particularly to a pixel data optimization method, a pixel matrix driving device and a display apparatus.

BACKGROUND

With the development of the information society, people's demand for display apparatus has grown rapidly. In order to meet this demand, the display apparatus represented by a liquid crystal display (LCD) device, a plasma displays panel (PDP) device, and an organic light emitting diode (OLED) device have all developed rapidly. Among flat panel display apparatus, the liquid crystal display apparatus is being used more and more widely due to its advantages of a low weight, a small size, and a low energy consumption.

The liquid crystal display apparatus includes a twisted nematic (TN) mode, an electronically controlled birefringence (ECB) mode, a vertical alignment (VA) mode and other display modes. Among them, the vertical alignment (VA) mode is a common display mode with advantages such as a high contrast, a wide viewing angle, and no rubbing alignment process. In order to reduce the problem of screen flicker in the VA mode liquid crystal display apparatus, a common polarity driving method is to keep the polarities of adjacent pixels opposite. The driving methods to realize the opposite polarity of adjacent pixels mainly include a point reversal, a column reversal, and a row reversal.

However, for VA mode liquid crystal display apparatus, the existing polarity driving method and some arrangements of pixels may cause overheating of the driver.

SUMMARY

In order to solve the above problem existing in the related art, the disclosure provides a pixel data optimization method, a pixel matrix driving device and a display. The problems to be solved by the disclosure is realized by the following technical schemes:

A pixel data optimization method, includes:

obtaining a first pixel data set, the first pixel data set includes pixel data of N rows and M columns of pixels, the pixel data of each of the N rows and M columns of pixels includes pixel data of three sub-pixels;

obtaining a second pixel data set according to the first pixel data set, the second pixel data set includes the pixel data of n rows and M columns of pixels in the N rows and M columns of pixels, $1<n\leq N$, and n is a positive integer;

obtaining an initial amplitude difference according to the pixel data of each two adjacent rows of pixels of the n rows and M columns of pixels in the second pixel data set; and obtaining pixel output data of the n rows and M columns of pixels according to the initial amplitude difference and a preset threshold.

According to an embodiment of the disclosure, obtaining a second pixel data set according to the first pixel data set includes: obtaining one the second pixel data set by acquiring the pixel data of n rows of pixels of the N rows and M columns of pixels as per a preset order from the first pixel data set.

According to an embodiment of the disclosure, obtaining an initial amplitude difference according to the pixel data of each two adjacent rows of pixels of the n rows and M columns of pixels in the second pixel data set includes:

obtaining pixel grayscale values of each two adjacent rows of pixels of the n rows and M columns of pixels in the second pixel data set;

obtaining a grayscale sum value according to a sum of absolute values of differences of the pixel grayscale values of each two adjacent rows of pixels to thereby obtain at least one grayscale sum value corresponding to the n rows and M columns of pixels;

obtaining the initial amplitude difference according to the at least one grayscale sum value and a total number of columns of the sub-pixels of the n rows and M columns of pixels.

According to an embodiment of the disclosure, obtaining pixel output data of the n rows and M columns of pixels according to the initial amplitude difference and a preset threshold includes:

comparing magnitudes of the initial amplitude difference and the preset threshold, the preset threshold includes a first preset threshold and a second preset threshold, and the second preset threshold is greater than the first preset threshold; taking initial pixel grayscale values of the n rows and M columns of pixels as the pixel output data, if the initial amplitude difference is less than the first preset threshold, obtaining pixel grayscale adjustment values of the sub-pixels in the n rows and M columns of pixels according to initial pixel grayscale values of the sub-pixels in the n rows and M columns of pixels, the first preset threshold and a first preset calculation value, if the initial amplitude difference is greater than the first preset threshold and less than the second preset threshold, obtaining pixel grayscale adjustment values of the sub-pixels in the n rows and M columns of pixels according to initial pixel grayscale values of the sub-pixels in the n rows and M columns of pixels, the second preset threshold and a second preset calculation value, if the initial amplitude difference is greater than the second preset threshold.

According to an embodiment of the disclosure, obtaining pixel grayscale adjustment values of the sub-pixels in the n rows and M columns of pixels according to initial pixel grayscale values of the sub-pixels in the n rows and M columns of pixels, the first preset threshold and a first preset calculation value includes:

comparing magnitudes of the initial pixel grayscale value of the sub-pixel at an $x_1$th row and a $y_1$th column in the n rows and M columns of pixels and the initial pixel grayscale value of the sub-pixel at an $(x_1+1)$th row and the $y_1$th column in the n rows and M columns of pixels; obtaining the pixel grayscale adjustment value of the sub-pixel at the $x_1$th row and the $y_1$th column according to a difference between the initial pixel grayscale value of the sub-pixel at the $x_1$th row and the $y_1$th column and a first calculation value, and obtaining the pixel grayscale adjustment value of the sub-pixel at the $(x_1+1)$th row and the $y_1$th column according to a sum of the initial pixel grayscale value of the sub-pixel at the $(x_1+1)$th row and the $y_1$th column and the first calculation value, if the initial pixel grayscale value of the sub-pixel at the $x_1$th row and the $y_1$th column is greater than the initial pixel grayscale value of the sub-pixel at the $(x_1+1)$th row and the $y_1$th column, obtaining the pixel grayscale adjustment value of the sub-pixel at the $x_1$th row and the $y_1$th column according to a sum of the initial pixel grayscale value of the sub-pixel at the $x_1$th row and the $y_1$th column and the first calculation value, and obtaining the pixel grayscale adjustment value of the sub-pixel at the $(x_1+1)$th row and the $y_1$th column according to a difference between the initial pixel grayscale value of the sub-pixel at the $(x_1+1)$th row and the $y_1$th column and the first calculation value, if the initial pixel grayscale value of the sub-pixel at the $x_1$th row and the $y_1$th column is less than the initial pixel grayscale value of the sub-pixel at the $(x_1+1)$th row and the $y_1$th column; the first calculation value is equal to a difference between the first preset calculation value and the first preset threshold.

According to an embodiment of the disclosure, obtaining pixel grayscale adjustment values of the sub-pixels in the n rows and M columns of pixels according to initial pixel grayscale values of the sub-pixels in the n rows and M columns of pixels, the second preset threshold and a second preset calculation value includes, comparing magnitudes of the initial pixel grayscale value of the sub-pixel at an $x_2$th row and a $y_2$th column in the n rows and M columns of pixels and the initial pixel grayscale value of the sub-pixel at an $(x_2+1)$th row and the $y_2$th column in the n rows and M columns of pixels; obtaining the pixel grayscale adjustment value of the sub-pixel at the $x_2$th row and the $y_2$th column according to a difference between the initial pixel grayscale value of the sub-pixel at the $x_2$th row and the $y_2$th column and a second calculation value, and obtaining the pixel grayscale adjustment value of the sub-pixel at the $(x_2+1)$th row and the $y_2$th column according to a sum of the initial pixel grayscale value of the sub-pixel at the $(x_2+1)$th row and the $y_2$th column and the second calculation value, if the initial pixel grayscale value of the sub-pixel at the $x_2$th row and the $y_2$th column is greater than the initial pixel grayscale value of the sub-pixel at the $(x_2+1)$th row and the $y_2$th column, obtaining the pixel grayscale adjustment value of the sub-pixel at the $x_2$th row and the $y_2$th column according to a sum of the initial pixel grayscale value of the sub-pixel at the $x_2$th row and the $y_2$th column and the second calculation value, and obtaining the pixel grayscale adjustment value of the sub-pixel at the $(x_2+1)$th row and the $y_2$th column according to a difference between the initial pixel grayscale value of the sub-pixel at the $(x_2+1)$th row and the $y_2$th column and the second calculation value, if the initial pixel grayscale value of the sub-pixel at the $x_2$th row and the $y_2$th column is less than the initial pixel grayscale value of the sub-pixel at the $(x_2+1)$th row and the $y_2$th column; the second calculation value is equal to a difference between the second preset calculation value and the second preset threshold.

According to an embodiment of the disclosure, obtaining pixel output data of the n rows and M columns of pixels according to the initial amplitude difference and a preset threshold includes, comparing magnitudes of the initial amplitude difference and the preset threshold, the preset threshold includes a third preset threshold; taking initial pixel grayscale values of the n rows and M columns of pixels as the pixel output data, if the initial amplitude difference is less than the third preset threshold, obtaining pixel grayscale adjustment values of the sub-pixels of each column in the n rows and M columns of pixels according to initial pixel grayscale values of the sub-pixels at the same column but respectively at a first row and a second row, if the initial amplitude difference is greater than the third preset threshold.

According to an embodiment of the disclosure, obtaining pixel grayscale adjustment values of the sub-pixels of each column in the n rows and M columns of pixels according to initial pixel grayscale values of the sub-pixels at the same column but respectively at a first row and a second row includes, comparing magnitudes of the initial pixel grayscale value of the sub-pixel at a first row and a $y_3$th column in the n rows and M columns of pixels and the initial pixel grayscale value of the sub-pixel at a second row and the $y_3$th column in the n rows and M columns of pixels; sorting the initial pixel grayscale values of the sub-pixels at the first row and the $y_3$th column through the nth row and $y_3$th column in an order from large to small, to obtain the pixel grayscale adjustment values of the sub-pixels at the first row and the $y_3$th column through the nth row and the $y_3$th column, if the initial pixel grayscale value of the sub-pixel at the first row and the $y_3$th column is greater than the initial pixel grayscale value of the sub-pixel at the second row and the $y_3$th column, sorting the initial pixel grayscale values of the sub-pixels at the first row and the $y_3$th column through the nth row and the $y_3$th column in order from small to large, to obtain the pixel grayscale adjustment values of the sub-pixels at the first row and the $y_3$th column through the nth row and the $y_3$th column, if the initial pixel grayscale value of the sub-pixel at the first row and the $y_3$th column is less than the initial pixel grayscale value at the sub-pixel of the second row and the $y_3$th column.

In addition, an embodiment of the disclosure provides a pixel matrix driving device, includes a memory, a timing controller and a data driver, the timing controller is configured for obtaining a first pixel data set, the first pixel data set includes pixel data of N rows and M columns of pixels, and the pixel data of each of the N rows and M columns of pixels includes pixel data of three sub-pixels;

the memory is configured for storing the first pixel data set;

the timing controller is further configured for obtaining a second pixel data set comprising the pixel data of n rows and M columns of pixels in the N rows and M columns of pixels according to the first pixel data set, obtaining an initial amplitude difference according to the pixel data of each two adjacent rows of pixels of the n rows and M columns of pixels in the second pixel data set, and obtaining pixel output data of the n rows and M columns of pixels according to the initial amplitude difference and a preset threshold, where $1<n\leq N$, and n is a positive integer;

the data driver is configured for supplying a pixel matrix with voltage signals corresponding to the pixel output data according to the pixel output data.

In addition, an embodiment of the disclosure also provides a display apparatus, includes the pixel matrix driving device described in any of the above embodiments, and the pixel matrix.

One of the above technical solutions may have the following advantages or benefits: by comparing the initial amplitude difference obtained from the pixel data of each two adjacent rows of pixels with the preset threshold, a pixel grayscale value to be final displayed of each pixel can be adjusted according to a comparison result, so that an energy consumption and an overheating phenomenon of the pixel matrix driving device can be improved, and a visual effect can be improved.

BRIEF DESCRIPTION OF THE DRAWINGS

In order to illustrate technical solutions of embodiments of the disclosure more clearly, drawings used in the embodiments will be briefly introduced below. Apparently, the drawings in the description below are merely some embodiments of the disclosure, a person skilled in the art can obtain other drawings according to these drawings without creative efforts.

FIG. 1 is a schematic view of a pixel arrangement design according to a related art.

FIG. 2 is a flowchart of a pixel data optimization method according to an embodiment of the disclosure.

FIG. 3 is a schematic view of a pixel matrix according to an embodiment of the disclosure.

FIG. 4 is a schematic view of a pixel matrix driving device according to an embodiment of the disclosure.

FIG. 5 is a schematic view of a comparison effect of different pixel arrangement designs according to an embodiment of the disclosure.

DETAILED DESCRIPTION OF EMBODIMENTS

Technical solutions of embodiments of the disclosure will be clearly and fully described in the following with reference to the accompanying drawings in the embodiments of the disclosure. Apparently, the described embodiments are some of the embodiments of the disclosure, but not all of the embodiments of the disclosure. All other embodiments obtained by skilled person in the art without creative efforts based on the described embodiments of the disclosure are within the scope of protection of the instant application.

First Embodiment

Please refer to FIG. 1, FIG. 1 is a schematic view of a pixel arrangement design according to a related art. At present, a liquid crystal display apparatus can simultaneously adopt a driving method of a column inversion and a pixel arrangement design of a flip pixel. Therefore, the pixel arrangement is H-stripe (horizontal stripe), this pixel arrangement will cause an overheating phenomenon of a pixel matrix driving device when a display pattern needs to be lit for a long time. For example, in the case of lighting for 30 minutes, the temperature of the same position of different COFs (Chip On Films) is 105.2° C., 100.4° C., 105.9° C., 108.2° C. and 106.7° C. respectively.

Please refer to FIG. 2, FIG. 2 is a flowchart of a pixel data optimization method according to an embodiment of the disclosure. Based on the above phenomenon, this embodiment proposes a pixel data optimization method, which can specifically include:

step 1: obtaining a first pixel data set, the first pixel data set includes pixel data of N rows and M columns of pixels, and the pixel data of each of the N rows and M columns of pixels includes pixel data of three sub-pixels;

step 2: obtaining a second pixel data set according to the first pixel data set, the second pixel data set includes the pixel data of n rows and M columns of pixels in the N rows and M columns of pixels, $1<n\leq N$, and n is a positive integer;

step 3: obtaining an initial amplitude difference according to the pixel data of each two adjacent rows of pixels of the n rows and M columns of pixels in the second pixel data set; and step 4: obtaining pixel output data of the n rows and M columns of pixels according to the initial amplitude difference and a preset threshold.

In this embodiment, when a display apparatus needs to perform pattern display, original pixel data of a pattern to be displayed is first transmitted to a timing controller. The original pixel data is a specific grayscale value of each sub-pixel in a pixel matrix of the display apparatus in each frame, and the value range of the pixel grayscale value is [0, 255]. The first pixel data set in this embodiment is a collection of pixel data of all pixels in a frame of pattern. Each frame can include N rows and M columns of pixels, N and M are integers greater than zero, the corresponding first pixel data set can include N rows and M columns of pixels, because each pixel may include three sub-pixels (R, G, B), and the corresponding pixel data of each pixel includes pixel data of three sub-pixels.

In addition, in order to speed up the processing speed, this embodiment can extract the second pixel data set from the first pixel data set in the order from the first row of pixels to the last row of pixels. The second pixel data set includes the pixel data of n rows and M columns of pixels, $1<n\leq N$. in this way, the first pixel data set can be split into several second pixel data sets. Thus, only one second pixel data set can be processed at a time, so that the data processing speed can be accelerated when the amount of data is large. In addition, when the amount of data is small and does not affect the processing speed, the first pixel data set can be directly processed as the second pixel data set.

The initial amplitude difference of this embodiment is used for judging whether it is necessary to adjust the pixel data of the pixel. The initial amplitude difference is obtained from the pixel data of each two adjacent rows of pixels in the second pixel data set. That is to say, the initial amplitude difference is obtained from the pixel grayscale values of each two adjacent rows of pixels in the second pixel data set, so the obtained initial amplitude difference can combine the pixel grayscale values of each two adjacent rows of pixels, and then we can compare the initial amplitude difference with the preset threshold, and adjust the pixel output data (the final pixel grayscale value) of the pixel according to the comparison result. For example, when the initial amplitude difference is less than the preset threshold, it means that the energy consumption is small, so it does not need to adjust the pixel output data of the pixel; when the initial amplitude difference is greater than the preset threshold, it means that the energy consumption is large, so it is necessary to adjust the pixel output data of the pixel to reduce the energy consumption. The preset threshold value of the embodiment can be determined according to the actual needs, and the embodiment does not specifically limit this.

In particular, the step 2 of this embodiment can be specifically as follows: obtaining one the second pixel data set by acquiring the pixel data of n rows of pixels of the N rows and M columns of pixels as per a preset order from the first pixel data set.

In other words, this embodiment first can extract the pixel data from the first row of pixels through the nth row of pixels in the first pixel data set to as one the second pixel data set, then extract the pixel data from the (n+1)th row of pixels through the (2*n)th row of pixels in the first pixel data set to as another the second pixel data set, and then extract the pixel data from the (2*n+1)th row of pixels through the (3*n)th row of pixels in the first pixel data set to as another the second pixel data set, and so on.

In particular, the step 3 of this embodiment can specifically include steps 3.1-3.3.

Step 3.1: obtaining pixel grayscale values of each two adjacent rows of pixels of the n rows and M columns of pixels in the second pixel data set.

This embodiment can obtain pixel grayscale values of each two adjacent rows of pixels in the second pixel data set in the order from the first row of pixels to the last row of pixels. That is, firstly, the pixel grayscale values of the first row of pixels and the second row of pixels are obtained, then, the pixel grayscale values of the second row of pixels and the third row of pixels are obtained, then the pixel grayscale values of the third row of pixels and the fourth row of pixels are obtained, and so on.

Step 3.2: obtaining a grayscale sum value according to a sum of absolute values of differences of the pixel grayscale values of each two adjacent rows of pixels to thereby obtain at least one grayscale sum value corresponding to the n rows and M columns of pixels.

In this embodiment, first, it needs to calculate the absolute values of the differences between the pixel grayscale values of each two adjacent rows of pixels in the second pixel data set, that is, first calculate the difference between the pixel grayscale values of two pixels in the same column and two adjacent rows, then calculate the absolute values of the differences between the pixel grayscale values of all pixels, and finally calculate the sum of the absolute values of the differences between the pixel grayscale values of all pixels to get at least one grayscale sum value. For example, referring to FIG. 3, the second pixel data set includes pixel data of 4 rows*4 columns of pixels, and each pixel includes 3 sub-pixels, so there are 4 rows*12 columns of sub-pixels, and 4 rows are respectively (n+1), (n+2), (n+3) and (n+4), then:

A grayscale sum value P1 of the (n+1)th row and the (n+2)th row is: $P1=|R1p1-R1c2|+|G1p1-G1c2|+|B1p1-B1c2|+|R2p1-R2c2|+ \ldots +|B4p1-B4c2|$, R1p1 is initial pixel grayscale value of the sub-pixel of the (n+1)th row and the first column, R1c2 is initial pixel grayscale value of the sub-pixel of the (n+2)th row and the first column, G1p1 is initial pixel grayscale value of the sub-pixel of the (n+1)th row and the second column, G1c2 is initial pixel grayscale value of the sub-pixel of the (n+2)th row and the second column, and so on, the initial pixel grayscale value is the original pixel data of the sub-pixel;

A grayscale sum value P2 of the (n+2)th row and the (n+3)th row is: $P2=|R1c2-R1p3|+|G1c2-G1p3|+|B1c2-B1p3|+|R2c2-R2p3|+ \ldots +|B4c2-B4p3|$, R1c2 is initial pixel grayscale value of the sub-pixel of the (n+2)th row and the first column, R1p3 is initial pixel grayscale value of the sub-pixel of the (n+3)th row and the first column, G1c2 is initial pixel grayscale value of the sub-pixel of the (n+2)th row and the second column, G1p3 is initial pixel grayscale value of the sub-pixel of the (n+3)th row and the second column, and so on;

A grayscale sum value P3 of the (n+3)th row and the (n+4)th row is $P3=|R1p3-R1c4|+|G1p3-G1c4|+|B1p3-B1c4|+|R2p3-R2c4|+ \ldots +|B4p3-B4c4|$, R1p3 is initial pixel grayscale value of the sub-pixel of the (n+3)th row and the first column, R1c4 is initial pixel grayscale value of the sub-pixel of the (n+4)th row and the first column, G1p3 is initial pixel grayscale value of the sub-pixel of the (n+3)th row and the second column, G1c4 is initial pixel grayscale value of the sub-pixel of the (n+4)th row and the second column, and so on.

step 3.3: obtaining the initial amplitude difference according to the at least one grayscale sum value and a total number of columns of the sub-pixels of the n rows and M columns of pixels.

In this embodiment, a sum of all grayscale sum values can be obtained first, and then a ratio of the sum of all grayscale sum values to the total number of columns of all sub-pixels can be calculated as the initial amplitude difference, for example, the initial amplitude difference obtained from FIG. 3: $\Delta P=(P1+p2+p3)/3M=(P1+p2+p3)/12$.

In this embodiment, by comparing the initial amplitude difference obtained from the pixel data of each two adjacent rows of pixels with the preset threshold, the pixel grayscale value to be final displayed of each pixel can be adjusted according to the comparison result, so that the energy consumption and the overheating phenomenon of the pixel matrix driving device can be improved, and the visual effect can be improved.

Second Embodiment

Based on the first embodiment, this embodiment further describes the pixel data optimization method proposed in the first embodiment. The pixel data optimization method proposed in this embodiment mainly uses the method of reducing the amplitude. This embodiment mainly introduces a specific embodiment of the step 4 in the first embodiment.

In particular, the step 4 of the first embodiment includes: comparing magnitudes of the initial amplitude difference and the preset threshold, wherein the preset threshold comprises a first preset threshold and a second preset threshold, and the second preset threshold is greater than the first preset threshold; taking initial pixel grayscale values of the n rows and M columns of pixels as the pixel output data, if the initial amplitude difference is less than the first preset threshold; obtaining pixel grayscale adjustment values of the sub-pixels in the n rows and M columns of pixels according to initial pixel grayscale value of the sub-pixels in the n rows and M columns of pixels, the first preset threshold, and a first preset calculation value, if the initial amplitude difference is greater than the first preset threshold and less than the second preset threshold, obtaining pixel grayscale adjustment values of the sub-pixels in the n rows and M columns of pixels according to initial pixel grayscale values of the sub-pixel in the n rows and M columns of pixels, and the second preset threshold and a second preset calculation value, if the initial amplitude difference is greater than the second preset threshold.

In this embodiment, the preset threshold includes a first preset threshold P_th_sta1 and a second preset threshold P_th_end, and the second preset threshold P_th_end is greater than the first preset threshold P_th_sta1.

Further, the second preset threshold P_th_end is equal to a sum of the first preset threshold P_th_sta1 and a set value P_len, that is P_th_end=P_th_sta1+P_len, P_len can be set as needed, for example, P_len=2^K, K is an integer greater than zero, the value range of P_th_sta1 may be 0 to 3 times of a maximum of the pixel grayscale values of the sub-pixels, that is, the value range of P_th_sta1 may be 0-3*255.

In this embodiment, it is necessary to judge a relationship between the initial amplitude difference and the first preset threshold and the second preset threshold. When the initial amplitude difference is less than the first preset threshold, it means that the energy consumption is low and there is no need to adjust the initial pixel grayscale values of the sub-pixels, then the pixel grayscale values of the n rows and M columns of pixels of the second pixel data set can as the pixel output value and directly output to the data driver through the timing controller; When the initial amplitude difference is greater than the first preset threshold and less than the second preset threshold, it indicates that the energy consumption is large and the pixel grayscale values of the sub-pixels need to be adjusted. At this time, the pixel grayscale adjustment value of the sub-pixel can be obtained by the initial pixel grayscale value of each sub-pixel in the n rows and M columns of pixels of the second pixel data set, the first preset threshold and a first preset calculation value. Among them, a calculation formula of the first preset value $P'_1$ is:

$P'_1$=(P_th_end/(P_len))*ΔP−((P_th_sta1*P_th_end)/P_len). the obtained pixel grayscale adjustment value of the sub-pixel is the pixel grayscale value to be corresponding final displayed of the sub-pixel; When the initial amplitude difference is greater than the second preset threshold, it indicates that the energy consumption is large and it is necessary to adjust the pixel grayscale value of the sub-pixel. Then, the pixel grayscale adjustment value of the sub-pixel can be obtained by the initial pixel gray scale value of each sub-pixel in the n rows and M columns of pixels, the second preset threshold and a second preset calculation value. The calculation formula of the second preset calculation value $P'_2$ is: $P'_2$=ΔP. That is, the second preset calculation value is equal to the initial amplitude difference, and the obtained pixel grayscale adjustment value of the sub-pixel is the pixel grayscale value to be corresponding final displayed of the sub-pixel.

Further, obtaining pixel grayscale adjustment values of the sub-pixels in the n rows and M columns of pixels according to initial pixel grayscale values of the sub-pixels in the n rows and M columns of pixels, the first preset threshold, and a first preset calculation value includes:

comparing magnitudes of the initial pixel grayscale value of the sub-pixel at an $x_1$th row and a $y_1$th column in the n rows and M columns of pixels and the initial pixel grayscale value of the sub-pixel at an $(x_1+1)$th row and the $y_1$th column in the n rows and M columns of pixels; obtaining the pixel grayscale adjustment value of the sub-pixel at the $x_1$th row and the $y_1$th column according to a difference between the initial pixel grayscale value of the sub-pixel at the $x_1$th row and the $y_1$th column and a first calculation value, and obtaining the pixel grayscale adjustment value of the sub-pixel at the $(x_1+1)$th row and the $y_1$th column according to a sum of the initial pixel grayscale value of the sub-pixel at the $(x_1+1)$th row and the $y_1$th column and the first calculation value, if the initial pixel grayscale value of the sub-pixel at the $x_1$th row and the $y_1$th column is greater than the initial pixel grayscale value of the sub-pixel at the $(x_1+1)$th row and the $y_1$th column, obtaining the pixel grayscale adjustment value of the sub-pixel at the $x_1$th row and the $y_1$th column according to a sum of the initial pixel grayscale value of the sub-pixel at the $x_1$th row and the $y_1$th column and the first calculation value, and obtaining the pixel grayscale adjustment value of the sub-pixel at the $(x_1+1)$th row and the $y_1$th column according to a difference between the initial pixel grayscale value of the sub-pixel at the $(x_1+1)$th row and the $y_1$th column and the first calculation value, if the initial pixel grayscale value of the sub-pixel at the $x_1$th row and the $y_1$th column is less than the initial pixel grayscale value of the sub-pixel at the $(x_1+1)$th row and the $y_1$th column; the first calculation value is equal to a difference between the first preset calculation value and the first preset threshold, that is the first calculation value P"=P'1−P_th_sta1, where $1 \le x_1 \le n$, $1 \le y_1 \le 3M$.

In this embodiment, when the initial amplitude difference is greater than the first preset threshold and less than the second preset threshold, it is necessary to judge the size relationship of the initial pixel grayscale values of two sub-pixels in the same column and in adjacent rows in the order from the first row to the nth row. For example, the initial pixel grayscale value of the sub-pixel at the $x_1$th row and the $y_1$th column is compared with the initial pixel gray scale value of the sub-pixel at the $(x_1+1)$th row and the $y_1$th column, when the initial pixel grayscale value of the sub-pixel at the $x_1$th row and the $y_1$th column is greater than that of the sub-pixel at the $(x_1+1)$th row and the $y_1$th column, the pixel grayscale adjustment value of the sub-pixel at the $x_1$th row and the $y_1$th column is equal to the difference between the initial pixel grayscale value of the sub-pixel at the $x_1$th row and the $y_1$th column and the first calculation value, and the pixel grayscale adjustment value of the sub-pixel at the $(x_1+1)$th row and the $y_1$th column is equal to the sum of the initial pixel grayscale value of the sub-pixel at the $(x_1+1)$th row and the $y_1$th column and the first calculation value. When the initial pixel grayscale value of the sub-pixel at the $x_1$th row and the $y_1$th column is less than that of the sub-pixel at the $(x_1+1)$th row and the $y_1$th column, the pixel grayscale adjustment value of the sub-pixel at the $x_1$th row and the $y_1$th column is equal to the sum of the initial pixel grayscale value of the sub-pixel at the $x_1$th row and the $y_1$th column and the first calculation value, and the pixel grayscale adjustment value of the sub-pixel at the $(x_1+1)$th row and the $y_1$th column is equal to the difference between the initial pixel grayscale value of the sub-pixel at the $(x_1+1)$th row and the $y_1$th column and the first calculation value.

For example, please refer to FIG. 3 again, this embodiment takes the first column of sub-pixels in FIG. 3 as an example, where P_th_sta1≤ΔP≤P_th_end;

In case 1: R1p1>R1c2, R1p3>R1c4, R1c2<R1p3;

Then: R1p1_out=R1p1−(P'1−P_th_sta1), R1c2_out=R1c2+(P'1−P_th_sta1), R1p3_out=R1p3−(P'1−P_th_sta1), R1c4_out=R1c4+(P'1−P_th_sta1);

In case 2: R1p1<R1c2, R1p3<R1c4, R1c2>R1p3;

Then: R1p1_out=R1p1+(P'1−P_th_sta1), R1c2_out=R1c2−(P'1−P_th_sta1), R1p3_out=R1p3+(P'1−P_th_sta1), R1c4_out=R1c4−(P'1−P_th_sta1);

In case 3: R1p1<R1c2, R1p3>R1c4;

Then: R1p1_out=R1p1+(P'1−P_th_sta1), R1c2_out=R1c2−(P'1−P_th_sta1), R1p3_out=R1p3−(P'1−P_th_sta1), R1c4_out=R1c4+(P'1−P_th_sta1);

In case 4: R1p1>R1c2, R1p3<R1c4;

Then: R1p1_out=R1p1−(P'1−P_th_sta1), R1c2_out=R1c2+(P'1−P_th_sta1), R1p3_out=R1p3+(P'1−P_th_sta1), R1c4_out=R1c4−(P'1−P_th_sta1);

Among them, R1p1_out is the pixel grayscale adjustment value of the sub-pixel of the (n+1)th row and the first column, R1c2_out is the pixel grayscale adjustment value of the sub-pixel of the (n+2)th row and the first column, R1p3_out is the pixel grayscale adjustment value of the sub-pixel of the (n+3)th row and the first column, and R1c4_out is the pixel grayscale adjustment value of the sub-pixel of the (n+4)th row and the first column.

Further, obtaining pixel grayscale adjustment values of the sub-pixels in the n rows and M columns of pixels according to initial pixel grayscale values of the sub-pixels in the n rows and M columns of pixels, and the second preset threshold and a second preset calculation value includes:

comparing magnitudes of the initial pixel grayscale value of the sub-pixel at an $x_2$th row and a $y_2$th column in the n rows and M columns of pixels and the initial pixel grayscale value of the sub-pixel at an $(x_2+1)$th row and the $y_2$th column in the n rows and M columns of pixels; obtaining the pixel grayscale adjustment value of the sub-pixel at the $x_2$th row and the $y_2$th column according to a difference between the initial pixel grayscale value of the sub-pixel at the $x_2$th row and the $y_2$th column and a second calculation value, and obtaining the pixel grayscale adjustment value of the sub-pixel at the $(x_2+1)$th row and the $y_2$th column according to a sum of the initial pixel grayscale value of the sub-pixel at the $(x_2+1)$th row and the $y_2$th column and the second calculation value, if the initial pixel grayscale value of the sub-pixel at the $x_2$th row and the $y_2$th column is greater than the initial pixel grayscale value of the sub-pixel at the $(x_2+1)$th row and the $y_2$th column, obtaining the pixel grayscale adjustment value of the sub-pixel at the $x_2$th row and the $y_2$th column according to a sum of the initial pixel grayscale value of the sub-pixel at the $x_2$th row and the $y_2$th column and the second calculation value, and obtaining the pixel grayscale adjustment value of the sub-pixel at the $(x_2+1)$th row and the $y_2$th column according to a difference between the initial pixel grayscale value of the sub-pixel at the $(x_2+1)$th row and the $y_2$th column and the second calculation value, if the initial pixel grayscale value of the sub-pixel at the $x_2$th row and the $y_2$th column is less than the initial pixel grayscale value of the sub-pixel at the $(x_2+1)$th row and the $y_2$th column; the second calculation value is equal to a difference between the second preset calculation value and the second preset threshold, the second calculation value $P'''=P'_2-P_th_end$, where $1 \le x_2 < n$, $1 \le y_2 < 3M$.

In this embodiment, when the initial amplitude difference is greater than the second preset threshold, it is necessary to judge the size relationship of the initial pixel grayscale values of two sub-pixels in the same column and in adjacent rows in the order from the first row to the nth row. For example, the initial pixel grayscale value of the sub-pixel at the $x_2$th row and the $y_2$th column is compared with the initial pixel grayscale value of the sub-pixel at the $(x_2+1)$th row and the $y_2$th column, when the initial pixel grayscale value of the sub-pixel at the $x_2$th row and the $y_2$th column is greater than that of the sub-pixel at the $(x_2+1)$th row and the $y_2$th column, the pixel grayscale adjustment value of the sub-pixel at the $x_2$th row and the $y_2$th column is equal to the difference between the initial pixel grayscale value of the sub-pixel at the $x_2$th row and the $y_2$th column and the second calculation value, and the pixel grayscale adjustment value of the sub-pixel at the $(x_2+1)$th row and the $y_2$th column is equal to the sum of the initial pixel grayscale value of the sub-pixel at the $(x_2+1)$th row and the $y_2$th column and the second calculation value. When the initial pixel grayscale value of the sub-pixel at the $x_2$th row and the $y_2$th column is less than that of the sub-pixel at the $(x_2+1)$th row and the $y_2$th column, the pixel grayscale adjustment value of the sub-pixel at the $x_2$th row and the $y_2$th column is equal to the sum of the initial pixel grayscale value of the sub-pixel at the $x_2$th row and the $y_2$th column and the second calculation value, and the pixel grayscale adjustment value of the sub-pixel at the $(x_2+1)$th row and the $y_2$th column is equal to the difference between the initial pixel grayscale value of the sub-pixel at the $(x_2+1)$th row and the $y_2$th column and the second calculation value.

For example, please refer to FIG. 3 again, this embodiment takes the first column of sub-pixels in FIG. 3 as an example, where $\Delta P \ge P_th_end$;

In case 1: $R1p1>R1c2$, $R1p3>R1c4$, $R1c2<R1p3$;

Then: $R1p1_out=R1p1-(P'2-P_th_end)$, $R1c2_out=R1c2+(P'2-P_th_end)$, $R1p3_out=R1p3-(P'2-P_th_end)$, $R1c4_out=R1c4+(P'2-P_th_end)$;

In case 2: $R1p1<R1c2$, $R1p3<R1c4$, $R1c2>R1p3$;

Then: $R1p1_out=R1p1+(P'2-P_th_end)$, $R1c2_out=R1c2-(P'2-P_th_end)$, $R1p3_out=R1p3+(P'2-P_th_end)$, $R1c4_out=R1c4-(P'2-P_th_end)$;

In case 3: $R1p1<R1c2$, $R1p3>R1c4$;

Then: $R1p1_out=R1p1+(P'2-P_th_end)$, $R1c2_out=R1c2-(P'2-P_th_end)$, $R1p3_out=R1p3-(P'2-P_th_end)$, $R1c4_out=R1c4+(P'2-P_th_end)$;

In case 4: $R1p1>R1c2$, $R1p3<R1c4$;

Then: $R1p1_out=R1p1-(P'2-P_th_end)$, $R1c2_out=R1c2+(P'2-P_th_end)$, $R1p3_out=R1p3+(P'2-P_th_end)$, $R1c4_out=R1c4-(P'2-P_th_end)$.

In this embodiment, the pixel grayscale value to be final displayed of the sub-pixel can be adjusted in this way, avoiding the problem of excessive voltage difference caused by the large difference between the pixel grayscale values of two adjacent sub-pixels on the same column. Therefore, an energy consumption can be reduced, and an overheating phenomenon can be avoided, and in this way, the displayed pattern can look smoother without obvious boundaries.

Third Embodiment

Based on the first embodiment, this embodiment further describes the pixel data optimization method proposed in the first embodiment. The pixel data optimization method proposed in this embodiment mainly uses the method of reducing the frequency. This embodiment mainly introduces another specific embodiment of the step 4 in the first embodiment.

In particular, the step 4 of the first embodiment includes: comparing magnitudes of the initial amplitude difference and the preset threshold, the preset threshold includes a third preset threshold; taking initial pixel grayscale values of the n rows and M columns of pixels as the pixel output data, if the initial amplitude difference is less than the third preset threshold, obtaining pixel grayscale adjustment values of the sub-pixels of each column in the n rows and M columns of pixels according to initial pixel grayscale values of the sub-pixels at the same column but respectively at a first row and a second row, if the initial amplitude difference is greater than the third preset threshold.

In this embodiment, the preset threshold includes the third preset threshold P_th_sta2, the value range of P_th_sta2 may be 0 to 3 times of a maximum of pixel grayscale values of the sub-pixels, that is, the value range of P_th_sta2 may be 0-3*255.

In this embodiment, it is necessary to judge a relationship between the initial amplitude difference and the third preset threshold. When the initial amplitude difference is less than the third preset threshold, it means that the energy consumption is low and there is no need to adjust the initial pixel grayscale values of the sub-pixels, then the pixel grayscale values of the n rows and M columns of pixels as the pixel output data and directly output to the data driver through the timing controller; When the initial amplitude difference is greater than the third preset threshold, it indicates that the energy consumption is large and the pixel grayscale values of the sub-pixels need to be adjusted. At this time, the initial pixel grayscale value of each sub-pixel can be adjusted by comparing the initial pixel grayscale value of the sub-pixel in the first row of the second pixel data set with the initial pixel grayscale value of the sub-pixel in the second row, so as to obtain the pixel grayscale adjustment value of each sub-pixel.

Further, obtaining pixel grayscale adjustment values of the sub-pixels of each column in the n rows and M columns of pixels according to initial pixel grayscale values of the sub-pixels at the same column but respectively at a first row and a second row includes:

comparing magnitudes of the initial pixel grayscale value of the sub-pixel at a first row and a $y_3$th column in the n rows and M columns of pixels and the initial pixel grayscale value of the sub-pixel at a second row and the $y_3$th column in the n rows and M columns of pixels; sorting the initial pixel grayscale values of the sub-pixels at the first row and the $y_3$th column through the nth row and $y_3$th column in an order from large to small, to obtain the pixel grayscale adjustment values of the sub-pixels at the first row and the $y_3$th column through the nth row and the $y_3$th column, if the initial pixel grayscale value of the sub-pixel at the first row and the $y_3$th column is greater than the initial pixel grayscale value of the sub-pixel at the second row and the $y_3$th column, sorting the initial pixel grayscale values of the sub-pixels at the first row and the $y_3$th column through the nth row and the $y_3$th column in order from small to large, to obtain the pixel grayscale adjustment values of the sub-pixels at the first row and the $y_3$th column through the nth row and the $y_3$th column, if the initial pixel grayscale value of the sub-pixel at the first row and the $y_3$th column is less than the initial pixel grayscale value at the sub-pixel of the second row and the $y_3$th column, where $1 \leq y_3 \leq 3M$.

In this embodiment, when the initial amplitude difference is greater than the third preset threshold, it is necessary to compare magnitudes of the initial pixel grayscale value of the sub-pixel at the first row and the $y_3$th column with the initial pixel grayscale value of the sub-pixel at the second row and the $y_3$th column. When the initial pixel grayscale value of the sub-pixel at the first row and the $y_3$th column is greater than the initial pixel grayscale value of the sub-pixels at the second row and the $y_3$th column, then sorting the initial pixel grayscale values of the sub-pixels at the first row and the $y_3$th column through the nth row and the $y_3$th column in the order from large to small, that is according to the size of the initial pixel grayscale values, the initial pixel grayscale values of the sub-pixel at the first row and the $y_3$th column to the sub-pixel at the nth row and the $y_3$th column are arranged in the order from large to small. The pixel grayscale adjustment value of the sub-pixel at the first row and the $y_3$th column is the maximum value of the initial pixel grayscale values from the sub-pixel at the first row and the $y_3$th column to the sub-pixel at the nth row and the $y_3$th column. The pixel grayscale adjustment value of the sub-pixel at the second row and the $y_3$th column is the initial pixel grayscale value at the second bit after sorting the initial pixel grayscale values from the sub-pixel at the first row and the $y_3$th column to the sub-pixel at the nth row and the $y_3$th column in the order from large to small. The pixel grayscale adjustment value of the sub-pixel at the third row and the $y_3$th column is the initial pixel grayscale value in the third bit after sorting the initial pixel grayscale values of the sub-pixel at the first row and the $y_3$th column to the sub-pixel at the nth row and the $y_3$th column in the order from large to small, and so on. When the initial pixel grayscale values of the sub-pixels at the first row and the $y_3$th column is less than the initial pixel grayscale values of the sub-pixels at the second row and the $y_3$th column, then adjusting the initial pixel grayscale values from the sub-pixel of the first row and the $y_3$th column to the sub-pixel of the nth row and the $y_3$th column in order from small to large, that is according to the size of the initial pixel grayscale value, the initial pixel grayscale values of the sub-pixel at the first row and the $y_3$th column to the sub-pixel at the nth row and the $y_3$th column are arranged in the order from small to large. The pixel grayscale adjustment value of the sub-pixel at the first row and the $y_3$th column is the minimum value of the initial pixel grayscale values from the sub-pixel at the first row and the $y_3$th column to the sub-pixel at the nth row and the $y_3$th column. The pixel grayscale adjustment value of the sub-pixel at the second row and the $y_3$th column is the initial pixel grayscale value in the second bit after sorting the initial pixel grayscale values from the sub-pixel at the first row and the $y_3$th column to the sub-pixel at the nth row and the $y_3$th column in the order from small to large. The pixel grayscale adjustment value of the sub-pixel at the third row and the $y_3$th column is the initial pixel grayscale value in the third bit after sorting the initial pixel grayscale values of the sub-pixel at the first row and the $y_3$th column to the sub-pixel at the nth row and the $y_3$th column in the order from small to large, and so on.

For example, please refer to FIG. 3 again, this embodiment takes the first column of sub-pixels in FIG. 3 as an example. When $\Delta P \leq P_th_sta2$, R1p1_out=R1p1, R1c2_out=R1c2, R1p3_out=R1p3, R1c4_out=R1c4;

When $P_th_sta2 \leq \Delta P$;

In case 1: R1p1>R1c2, R1p3>R1c4;

Then: R1p1_out=max(R1p1, R1c1, R1p3, R1c4),
R1c2_out=mad1 (R1p1, R1c1, R1p3, R1c4),
R1p3_out=mad2 (R1p1, R1c1, R1p3, R1c4),
R1c4_out=min(R1p1, R1c1, R1p3, R1c4);

In case 2: R1p1<R1c2, R1p3<R1c4;

Then: R1p1_out=min(R1p1, R1c1, R1p3, R1c4),
R1c2_out=mad2 (R1p1, R1c1, R1p3, R1c4),
R1p3_out=mad1 (R1p1, R1c1, R1p3, R1c4),
R1c4_out=max(R1p1, R1c1, R1p3, R1c4);

In case 3: R1p1<R1c2, R1p3>R1c4;

Then: R1p1_out=min(R1p1, R1c1, R1p3, R1c4);
R1c2_out=mad2 (R1p1, R1c1, R1p3, R1c4);
R1p3_out=mad1 (R1p1, R1c1, R1p3, R1c4);
R1c4_out=max(R1p1, R1c1, R1p3, R1c4);

In case 4: R1p1>R1c2, R1p3<R1c4;

Then: R1p1_out=max(R1p1, R1c1, R1p3, R1c4);
R1c2_out=mad1 (R1p1, R1c1, R1p3, R1c4);
R1p3_out=mad2 (R1p1, R1c1, R1p3, R1c4);
R1c4_out=min(R1p1, R1c1, R1p3, R1c4).

Specifically, mad1 is the initial pixel grayscale value which is ranked second in the order from large to small, mad2 is the initial pixel grayscale value which is ranked third in the order from large to small, R1p1_out is the pixel grayscale adjustment value of the sub-pixel at the (n+1)th row and the first column, R1c2_out is the pixel grayscale adjustment value of the sub-pixel at the (n+2)th row and the first column, R1p3_out is the pixel grayscale adjustment value of the sub-pixel at the (n+3)th row and the first column, R1c4_out is the pixel grayscale adjustment value of the sub-pixel at the (n+4)th row and the first column.

In this embodiment, when the initial amplitude difference is greater than the third preset threshold, it means that the greater the difference between the initial pixel grayscale values of two adjacent rows of the sub-pixels in the same column, the greater the voltage difference will be, which will increase the energy consumption and cause overheating. After the adjustment according to the method of this embodiment, the difference between the initial pixel grayscale values of two adjacent rows of the sub pixels in the same column will be reduced, so that the voltage difference can be reduced, thus the energy consumption can be reduced, and the overheating phenomenon can be reduced.

Fourth Embodiment

Please refer to FIG. 4, FIG. 4 is a schematic view of a pixel matrix driving device according to an embodiment of the disclosure. This embodiment provides a pixel matrix driving device based on the above embodiments, including a memory, a timing controller and a data driver.

The timing controller is configured for obtaining a first pixel data set, the first pixel data set includes pixel data of N rows and M columns of pixels, and the pixel data of each of the N rows and M columns of pixels includes pixel data of three sub-pixels.

The memory connects with the timing controller, configured for storing the first pixel data set.

The timing controller is further configured for obtaining a second pixel data set including the pixel data of n rows and M columns of pixels in the N rows and M columns of pixels according to the first pixel data set, obtaining an initial amplitude difference according to the pixel data of each two adjacent rows of pixels of the n rows and M columns of pixels in the second pixel data set, and obtaining pixel output data of the n rows and M columns of pixels according to the initial amplitude difference and a preset threshold, where $1<n\leq N$, and n is a positive integer.

The data driver is configured for supplying a pixel matrix with voltage signals corresponding to the pixel output data according to the pixel output data.

That is to say, in this embodiment, when the display apparatus needs to display the pattern, First, the first pixel data set of the pattern to be displayed is transmitted to the timing controller, then, the timing controller first stores the first pixel data set in the memory, such as a line buffer, then, the timing controller intercepts the second pixel data set from the first pixel data set stored in the memory, and obtains the pixel output data of the pixel through the processing of the timing controller, the data driver can provide the pixel matrix with the voltage signals corresponding to the pixel output data of each pixel and apply it to the corresponding pixels according to the pixel output data of each pixel.

The pixel matrix driving device of this embodiment also includes a gate driver, configured for outputting corresponding gate driving signals.

Please refer to FIG. 5, FIG. 5 includes three of pixel arrangements. The three of pixel arrangements are the H-stripe pixel arrangement mode, the pixel arrangement mode obtained by adjusting the H-stripe pixel arrangement mode by reducing the amplitude (i.e. the method of the second embodiment), and the pixel arrangement mode obtained by adjusting the H-stripe pixel arrangement mode by reducing the frequency (i.e. the method of the third embodiment). Comparing the three modes, the temperatures of the same position on different COF1、COF2、COF3、COF4 and COF5 were measured respectively, and AVE is an average of the temperature. It can be seen from the comparison that the two methods of this embodiment greatly improve the power consumption. For the method of the second embodiment, the power consumption calculation method is $T=\Delta P_2/\Delta P_1$, where $\Delta P_1$ is the initial amplitude difference corresponding to the H-stripe pixel arrangement, and $\Delta P_2$ is the initial amplitude difference corresponding to the pixel arrangement obtained by adjusting the H-stripe pixel arrangement by reducing the amplitude. T is a degree of improvement of power consumption, For example, $T=\Delta P2/\Delta P1=(3*64)/(3*128)=50\%$. For the method of the third embodiment, the power consumption calculation method is T=D1/D2, D1 is the initial frequency, and the initial frequency is the compactness of the pixel arrangement corresponding to the H-stripe pixel arrangement, for example, D1=2, that is, the first row is 128 gray value, the second row is 0 gray value, the third row is 128 gray value, and the fourth row is 0 gray value, then D1 is 2, D2 is the frequency obtained by adjusting the H-stripe pixel arrangement by reducing the frequency. For example, D2=2, that is, the first row is 128 gray value, the second row is 128 gray value, the third row is 0 gray value, and the fourth row is 0 gray value, then D2 is 4, T=D1/D2=2/4=50%.

The pixel matrix driving device provided by the embodiment of the disclosure can implement the above pixel data optimization method, and its implementation principle and technical effect are similar, so it will not be repeated here.

Fifth Embodiment

The embodiment of the disclosure also provides a display apparatus, which includes the pixel matrix driving device provided by the above embodiment of the disclosure and the pixel matrix. For example, the display apparatus can be LTPO display apparatus, Micro LED display apparatus, liquid crystal panel, electronic paper, OLED panel, AMOLED panel, mobile phone, tablet computer, TV, monitor, notebook computer, digital photo frame and other products or components with display function.

The display apparatus provided by the embodiment of the disclosure can implement the above pixel matrix driving method, and its implementation principle and technical effect are similar, so it will not be repeated here.

In the description of the disclosure, the terms "first" and "second" are used for descriptive purposes only, and cannot be understood as indicating or implying relative importance or implicitly indicating the number of technical features indicated. Thus, the features defined with "first" and "second" can explicitly or implicitly include one or more of the features. In the description of the disclosure, "multiple" means two or more, unless otherwise specifically defined.

In the description of this specification, reference to the description of the terms "one embodiment", "some embodiments", "examples", "specific examples", or "some examples" means that a specific feature, structure, material, or feature described in connection with the embodiment or example is included in at least one embodiment or example of the disclosure. In this specification, the schematic expression of the above terms does not have to refer to the same embodiment or example. Moreover, the specific features, structures, materials, or features described may be combined in a suitable manner in any one or more embodiments or examples. In addition, those skilled in the art may join and combine the different embodiments or examples described in this specification.

Finally, it should be noted that the above embodiments are only for exemplary illustrating the technical solutions of the disclosure, but not intended for limiting the disclosure; although the disclosure has been described in detail with reference to the foregoing embodiments, for the person skilled in the art of the disclosure, it should be understood that the technical solutions described in the foregoing embodiments may be modified, or some of the technical features may be equivalently substituted; and these modifications or substitutions do not make the essences of corresponding technical solutions deviate from the spirit and scope of the technical solutions of the embodiments of the disclosure.

What is claimed is:

1. A pixel data optimization method, comprising:

obtaining a first pixel data set, wherein the first pixel data set comprises pixel data of N rows and M columns of pixels, the pixel data of each of the N rows and M columns of pixels comprises pixel data of three sub-pixels;

obtaining a second pixel data set according to the first pixel data set, wherein the second pixel data set comprises the pixel data of n rows and M columns of pixels in the N rows and M columns of pixels, $1<n\leq N$, and n is a positive integer;

obtaining an initial amplitude difference according to the pixel data of each two adjacent rows of pixels of the n rows and M columns of pixels in the second pixel data set;

obtaining pixel output data of the n rows and M columns of pixels according to the initial amplitude difference and a preset threshold; and supplying a pixel matrix with voltage signals corresponding to the pixel output data according to the pixel output data;

wherein obtaining pixel output data of the n rows and M columns of pixels according to the initial amplitude difference and a preset threshold comprises:

comparing magnitudes of the initial amplitude difference and the preset threshold, wherein the preset threshold comprises a first preset threshold and a second preset threshold, and the second preset threshold is greater than the first preset threshold;

taking initial pixel grayscale values of the n rows and M columns of pixels as the pixel output data, if the initial amplitude difference is less than the first preset threshold, obtaining pixel grayscale adjustment values of the sub-pixels in the n rows and M columns of pixels according to initial pixel grayscale values of the sub-pixels in the n rows and M columns of pixels, the first preset threshold and a first preset calculation value, if the initial amplitude difference is greater than the first preset threshold and less than the second preset threshold, obtaining pixel grayscale adjustment values of the sub-pixels in the n rows and M columns of pixels according to initial pixel grayscale values of the sub-pixels in the n rows and M columns of pixels, the second preset threshold and a second preset calculation value, if the initial amplitude difference is greater than the second preset threshold.

2. The pixel data optimization method according to claim 1, wherein obtaining a second pixel data set according to the first pixel data set comprises:

obtaining one the second pixel data set by acquiring the pixel data of n rows of pixels of the N rows and M columns of pixels as per a preset order from the first pixel data set.

3. The pixel data optimization method according to claim 1, wherein obtaining an initial amplitude difference according to the pixel data of each two adjacent rows of pixels of the n rows and M columns of pixels in the second pixel data set comprises:

obtaining pixel grayscale values of each two adjacent rows of pixels of the n rows and M columns of pixels in the second pixel data set;

obtaining a grayscale sum value according to a sum of absolute values of differences of the pixel grayscale values of each two adjacent rows of pixels to thereby obtain at least one grayscale sum value corresponding to the n rows and M columns of pixels; and obtaining the initial amplitude difference according to the at least one grayscale sum value and a total number of columns of the sub-pixels of the n rows and M columns of pixels.

4. The pixel data optimization method according to claim 1, wherein obtaining pixel grayscale adjustment values of the sub-pixels in the n rows and M columns of pixels according to initial pixel grayscale values of the sub-pixels in the n rows and M columns of pixels, the first preset threshold and a first preset calculation value comprises:

comparing magnitudes of the initial pixel grayscale value of the sub-pixel at an $x_1$th row and a $y_1$th column in the n rows and M columns of pixels and the initial pixel grayscale value of the sub-pixel at an $(x_1+1)$th row and the $y_1$th column in the n rows and M columns of pixels;

obtaining the pixel grayscale adjustment value of the sub-pixel at the $x_1$th row and the $y_1$th column according to a difference between the initial pixel grayscale value of the sub-pixel at the $x_1$th row and the $y_1$th column and a first calculation value, and obtaining the pixel grayscale adjustment value of the sub-pixel at the $(x_1+1)$th row and the $y_1$th column according to a sum of the initial pixel grayscale value of the sub-pixel at the $(x_1+1)$th row and the $y_1$th column and the first calculation value, if the initial pixel grayscale value of the sub-pixel at the $x_1$th row and the $y_1$th column is greater than the initial pixel grayscale value of the sub-pixel at the $(x_1+1)$th row and the $y_1$th column, obtaining the pixel grayscale adjustment value of the sub-pixel at the $x_1$th row and the $y_1$th column according to a sum of the initial pixel grayscale value of the sub-pixel at the $x_1$th row and the $y_1$th column and the first calculation value, and obtaining the pixel grayscale adjustment value of the sub-pixel at the $(x_1+1)$th row and the $y_1$th column according to a difference between the initial pixel grayscale value of the sub-pixel at the $(x_1+1)$th row and the $y_1$th column and the first calculation value, if the initial pixel grayscale value of the sub-pixel at the $x_1$th row and the $y_1$th column is less than the initial pixel grayscale value of the sub-pixel at the $(x_1+1)$th row and the $y_1$th column;

wherein the first calculation value is equal to a difference between the first preset calculation value and the first preset threshold.

5. The pixel data optimization method according to claim 1, wherein obtaining pixel grayscale adjustment values of the sub-pixels in the n rows and M columns of pixels according to initial pixel grayscale values of the sub-pixels in the n rows and M columns of pixels, the second preset threshold and a second preset calculation value comprises:

comparing magnitudes of the initial pixel grayscale value of the sub-pixel at an $x_2$th row and a $y_2$th column in the n rows and M columns of pixels and the initial pixel grayscale value of the sub-pixel at an $(x_2+1)$th row and the $y_2$th column in the n rows and M columns of pixels;

obtaining the pixel grayscale adjustment value of the sub-pixel at the $x_2$th row and the $y_2$th column according to a difference between the initial pixel grayscale value of the sub-pixel at the $x_2$th row and the $y_2$th column and a second calculation value, and obtaining the pixel grayscale adjustment value of the sub-pixel at the $(x_2+1)$th row and the $y_2$th column according to a sum of the initial pixel grayscale value of the sub-pixel at the $(x_2+1)$th row and the $y_2$th column and the second calculation value, if the initial pixel grayscale value of the sub-pixel at the $x_2$th row and the $y_2$th column is greater than the initial pixel grayscale value of the sub-pixel at the $(x_2+1)$th row and the $y_2$th column, obtaining the pixel grayscale adjustment value of the sub-pixel at the $x_2$th row and the $y_2$th column according to a sum of the initial pixel grayscale value of the sub-pixel at the $x_2$th row and the $y_2$th column and the second calculation value, and obtaining the pixel grayscale adjustment value of the sub-pixel at the $(x_2+1)$th row and the $y_2$th column according to a difference between the initial pixel grayscale value of the sub-pixel at the $(x_2+1)$th row and the $y_2$th column and the second calculation value, if the initial pixel grayscale value of the sub-pixel at the $x_2$th row and the $y_2$th column is less than the initial pixel grayscale value of the sub-pixel at the $(x_2+1)$th row and the $y_2$th column;

wherein the second calculation value is equal to a difference between the second preset calculation value and the second preset threshold.

6. A pixel matrix driving device comprising: a memory, a timing controller and a data driver; wherein the timing controller is configured for obtaining a first pixel data set, wherein the first pixel data set comprises pixel data of N rows and M columns of pixels, and the pixel data of each of the N rows and M columns of pixels comprises pixel data of three sub-pixels;

the memory is configured for storing the first pixel data set;

the timing controller is further configured for obtaining a second pixel data set comprising the pixel data of n rows and M columns of pixels in the N rows and M columns of pixels according to the first pixel data set, obtaining an initial amplitude difference according to the pixel data of each two adjacent rows of pixels of the n rows and M columns of pixels in the second pixel data set, and obtaining pixel output data of the n rows and M columns of pixels according to the initial amplitude difference and a preset threshold, where $1<n\leq N$, and n is a positive integer; and the data driver is configured for supplying a pixel matrix with voltage signals corresponding to the pixel output data according to the pixel output data;

wherein obtaining pixel output data of the n rows and M columns of pixels according to the initial amplitude difference and a preset threshold specifically comprises:

comparing magnitudes of the initial amplitude difference and the preset threshold, wherein the preset threshold comprises a first preset threshold and a second preset threshold, and the second preset threshold is greater than the first preset threshold;

taking initial pixel grayscale values of the n rows and M columns of pixels as the pixel output data, if the initial amplitude difference is less than the first preset threshold, obtaining pixel grayscale adjustment values of the sub-pixels in the n rows and M columns of pixels according to initial pixel grayscale values of the sub-pixels in the n rows and M columns of pixels, the first preset threshold and a first preset calculation value, if the initial amplitude difference is greater than the first preset threshold and less than the second preset threshold, obtaining pixel grayscale adjustment values of the sub-pixels in the n rows and M columns of pixels according to initial pixel grayscale values of the sub-pixels in the n rows and M columns of pixels, the second preset threshold and a second preset calculation value, if the initial amplitude difference is greater than the second preset threshold.

7. A display apparatus comprising: the pixel matrix driving device of the claim 6, and the pixel matrix.

* * * * *